US007351507B2

(12) United States Patent
Nozoe et al.

(10) Patent No.: US 7,351,507 B2
(45) Date of Patent: Apr. 1, 2008

(54) ELECTROPHOTOGRAPHIC PHOTORECEPTOR, IMAGE FORMING APPARATUS AND METHOD, AND IMAGE PROCESS CARTRIDGE

(75) Inventors: Suzuka Nozoe, Odawara (JP); Takehiko Kinoshita, Mishima (JP)

(73) Assignee: Ricoh Company, Limited, Tokyo (JP)

( * ) Notice: Subject to any disclaimer, the term of this patent is extended or adjusted under 35 U.S.C. 154(b) by 465 days.

(21) Appl. No.: 10/940,795

(22) Filed: Sep. 15, 2004

(65) Prior Publication Data

US 2005/0112484 A1 May 26, 2005

(30) Foreign Application Priority Data

Sep. 17, 2003 (JP) ..... 2003-324905

(51) Int. Cl.
*G03G 5/14* (2006.01)
*G03G 21/00* (2006.01)

(52) U.S. Cl. ..... 430/65; 430/60; 430/119.7; 399/159

(58) Field of Classification Search ..... 430/64, 430/65, 124, 125, 119.7, 60; 399/159
See application file for complete search history.

(56) References Cited

U.S. PATENT DOCUMENTS 4,518,669 A 5/1985 Yashiki
5,677,096 A 10/1997 Suzuki
6,026,262 A 2/2000 Kinoshita et al.
6,136,483 A 10/2000 Suzuki et al.
2002/0142239 A1* 10/2002 Sakimura et al. ..... 430/60
2006/0188785 A1* 8/2006 Inoue et al. ..... 429/246

FOREIGN PATENT DOCUMENTS

JP 06-236061 8/1994
JP 11-065153 3/1999
JP 11-202518 7/1999
JP 2000-171997 6/2000
JP 2000-181113 6/2000
JP 2001-296681 10/2001
JP 2003098705 A * 4/2003
JP 2004177552 A * 6/2004

OTHER PUBLICATIONS

U.S. Appl. No. 10/087,726, filed Mar. 1, 2002.
U.S. Appl. No. 09/679,480, filed Oct. 5, 2000, Suzuki et al.
U.S. Appl. No. 11/332,545, filed Jan. 17, 2006, Tamoto et al.
U.S. Appl. No. 11/367,786, filed Mar. 6, 2006, Ohta et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

An electrophotographic photoreceptor and image processing method, the photoreceptor including an electroconductive substrate; an undercoat layer overlying the electroconductive substrate; and a photosensitive layer overlying the undercoat layer, wherein the undercoat layer includes a titanium oxide; an oil-free alkyd resin; a block isocyanate compound; and a metal oxide different from the titanium oxide, having an average particle diameter smaller than an average particle diameter thereof.

10 Claims, 2 Drawing Sheets

ELECTROPHOTOGRAPHIC PHOTORECEPTOR, IMAGE FORMING APPARATUS AND METHOD, AND IMAGE PROCESS CARTRIDGE

BACKGROUND OF THE INVENTION

1. Field of the Invention

The present invention relates to an electrophotographic photoreceptor for use in laser printers, digital copiers and laser facsimiles. The invention also relates to a corresponding electrophotographic image forming apparatus and method, and a corresponding image process cartridge.

2. Discussion of the Background

Electrophotographic image forming devices can produce high-quality images at a high-speed, and are used for copiers and laser beam printers. An organic photoreceptor using an organic photoconductive material has been developed and has gradually become widely used as a photoreceptor in electrophotographic image forming devices. Over time, the photoreceptor has changed from a) a charge transporting complex constitution or a single-layered constitution wherein a charge generation material is dispersed in a binder resin to b) a functionally-separated constitution wherein a photosensitive layer is separated into charge generation layer and a charge transport layer, and has improved its performance. The currently prevailing approach includes use of a functionally-separated photoreceptor having a constitution wherein an undercoat layer is formed on an aluminum substrate, a charge generation layer is formed on the undercoat layer and a charge transport layer is formed on the charge generation layer.

In conventional systems, the undercoat layer is formed to improve adhesiveness, coatability, chargeability of the photosensitive layer, and to prevent an unnecessary charge from the substrate from entering the photosensitive layer and cover a defect on the substrate. The undercoat layer typically includes only a binder resin and an undercoat layer including a binder resin and a pigment.

Specific examples of resins used in the undercoat layer include water-soluble resins such as polyvinylalcohol and casein; alcohol-soluble resins such as nylon copolymers; and hardened resins having a three-dimensional network such as polyurethane, melamine resins, phenol resins, phenol resins, oil-free alkyd resins, epoxy resins and siloxane resins.

Although water-soluble resins are inexpensive and have good properties, a solvent for a photosensitive layer coating liquid dissolves the water-soluble resins and frequently deteriorates a coatability of the undercoat layer. Nylon alcohol-soluble resins are highly sensitive to environment because of their high water absorbability and affinity, and therefore the resultant photoreceptor changes its properties according to humidity.

In an atmosphere of high humidity, a photoreceptor having an undercoat layer using alcohol-soluble resins, particularly the nylon resins, absorb a large amount of water in the undercoat layer, and therefore properties thereof change significantly when repeatedly used in an environment of high temperature and high humidity or a low temperature and low humidity. This results in production of abnormal images such as black spots and deterioration of image density.

It is well known that an inorganic pigment such as titanium oxide may be dispersed in the undercoat layer to enhance a hiding effect of the defect on the substrate and a scattering effect of incident light such as coherence light (a laser beam) to prevent occurrence of an interference pattern.

However, the above-mentioned deficiency in the face of humidity does not change even when the inorganic pigment is mixed with the nylon resins.

Among hardened resins having a three-dimensional network, a large amount of formaldehyde is used to form melamine resins, alkyd/melamine resins, acryl/melamine resins, phenol resins and methoxymethylated nylon. Therefore, unreacted materials are absorbed in the resins and the formaldehyde generates in a heat cross-linking process after the undercoat layer is formed. However, formaldehyde is an indoor pollutant listed in the Clean Air Act and is said to be a cause of an illness known as "sick house syndrome." Thus, to prevent formaldehyde from being discharged to the atmosphere, expensive collection equipment needs to be used.

Therefore, there exists a demand for a less environmentally-damaging heat-crosslinking resin for use an undercoat layer, where the resin does not generate formaldehyde when hardened with heat. Specific examples of the resins include urethane resins. To harden the urethane resins, a compound, including a group including an active hydrogen such as acrylpolyol, is dried with hot air for a predetermined period of time in the presence of a hardener, such as a monomer including an isocyanate group, such that a three-dimensional network crosslinking reaction between the group including an active hydrogen of the acrylpolyol and isocyanate group of the hardener starts to form a hardened film. However, since the isocyanate group has a high reactivity, a coating liquid using the isocyanate group has a short usable time. Therefore, a block isocyanate having a long pot life in a coating liquid for an electrophotographic photoreceptor and an isocyanate coating material, which is stable in the presence of alcohol-soluble chemicals, water-soluble chemicals or the compound including a group including an active hydrogen, is a topic of ongoing research.

The block isocyanate includes an isocyanate group protected with a blocker such as oxime and starts an addition reaction with a compound, including a group including active hydrogen such as a hydroxyl group, when heated and the blocker is removed to proceed a crosslinking reaction.

However, coherent light makes a regular reflection on a surface of the undercoat layer using the oil-free alkyd resin and block isocyanate, resulting in occurrence of moire. Therefore, the coherent light is forced to scatter thereon.

To prevent the moire and interference pattern, Japanese Laid-Open Patent Publications Nos. 11-65156 and 2000-171997 disclose an electrophotographic photoreceptor including a surface-treated or a resin-coated particulate material in its undercoat layer. However, when the particulate material is coated with a resin, a residual potential of the resultant photoreceptor increases, which is considered to be caused by increase of a surface resistance of a pigment in an environment of high temperature and high humidity. Thus, when the resultant photoreceptor is installed in an image forming apparatus, black part potential increases, resulting in deterioration of image density.

Japanese Laid-Open Patent Publication No. 11-202518 discloses an electrophotographic photoreceptor including a zirconium oxide in an amount of not less than 20% by weight in its undercoat layer. However, the electrophotographic photoreceptor probably has similar problems to the above problems.

Japanese Laid-Open Patent Publication No. 2000-181113 discloses an organic photoreceptor drum including a layer in which an electroconductive powder is dispersed. However, when a photoreceptor includes at least the electroconductive powder-dispersed layer and a photosensitive layer, a low-resistance pigment used as the electroconductive powder and a charge generation material are probably present while contacting with each other. Therefore, a charge easily enters the photosensitive layer and a surface charge leaks at the contact point when the photoreceptor is charged. In addition, when the organic photoreceptor drum is installed in a reverse development image forming apparatus, images having black spots in their blanks tend to be produced.

Japanese Laid-Open Patent Publication No. 6-236061 discloses an electrophotographic photoreceptor including a white pigment and an airspace of not less than 10% by volume fraction in its undercoat layer. However, when a photosensitive layer is coated and dried thereon, the airspace causes an air bubble in the photosensitive layer, resulting in a defectively coated photosensitive layer. In addition, JP 6-236061 discloses that a resin layer is formed between the electroconductive-powder-dispersed layer and photosensitive layer. However, the resultant photoreceptor properties largely change depending on the resin, and the resin layer therebetween results in a new photosensitive layer which causes a higher cost.

Therefore, as discovered by the present inventors, a demand exists for an improved electrophotographic photoreceptor apparatus and method which does not produce images having the moire or interference pattern.

SUMMARY OF THE INVENTION

Accordingly, an object of the present invention is to provide an electrophotographic photoreceptor without an environmental dependency, and capable of producing images without interference patterns in an electrophotographic image forming apparatus using a digital irradiator and images with black spots.

Another object of the present invention is to provide an electrophotographic image forming apparatus and a process cartridge equipped with the above-described electrophotographic photoreceptor.

The present invention includes an electrophotographic photoreceptor including an electroconductive substrate; an undercoat layer overlying the electroconductive substrate; and a photosensitive layer, wherein the undercoat layer includes a titanium oxide; an oil-free alkyd resin; a block isocyanate compound; and a metal oxide different from the titanium oxide, having an average particle diameter smaller than an average particle diameter thereof.

In one embodiment, the titanium oxide has an average particle diameter (A) of from 0.05 to 1 μm, the metal oxide has an average particle diameter (B) of from 0.01 to 0.5 μm, and that A is larger than B.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides an electrophotographic photoreceptor preventing moire images on halftone images and black spots on blank images, and being resistant to repeated use and the environment.

Figure 1:
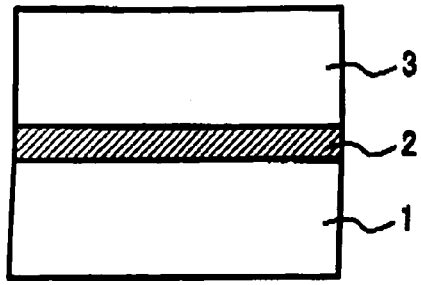
FIG. 1 is a cross-sectional view of an embodiment of layers of the electrophotographic photoreceptor of the present invention.
Figure 2:
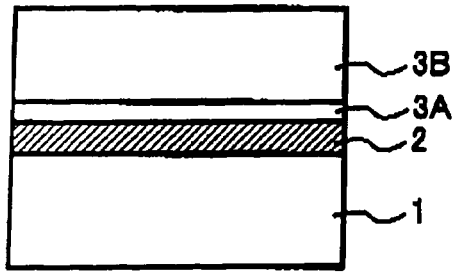
FIG. 2 is a cross-sectional view of another embodiment of layers of the electrophotographic photoreceptor of the present invention.

FIG. 1 is a cross-sectional view of an embodiment of layers of the electrophotographic photoreceptor of the present invention, wherein at least an undercoat layer 2 and a photosensitive layer 43 are overlaid on an electroconductive substrate 1. FIG. 2 is a cross-sectional view of another embodiment of layers of the electrophotographic photoreceptor of the present invention, wherein an undercoat layer 2, a charge generation layer 3A and a charge transport layer are overlaid on an electroconductive substrate 1.

The undercoat layer 2 includes at least a titanium oxide and a metal oxide different therefrom. The titanium oxide preferably has a purity not less than 99.2%. Impurities thereof are mostly hygroscopic materials such as $Na_2O$ and $K_2O$, and ionic materials. When the purity is less than 99.2%, properties of the resultant photoreceptor largely change due to the environment (particularly to the humidity) and repeated use. Further, the impurities tend to cause defective images such as black spots.

In the present invention, the purity of the titanium oxide in the undercoat layer can be determined by a measurement method specified in JIS K5116, the entire contents of which are incorporated by reference. Specific examples of the metal oxide different from the titanium oxide include an aluminum oxide, a zinc oxide, a lead white, a silicon oxide, an indium oxide, a zirconium oxide, a magnesium oxide, etc., where aluminum oxide is preferably used.

To prevent the moire image when writing with coherent light, a regular reflection thereof on a surface of the undercoat layer has to be prevented, i.e., the coherent light has to be scattered. Therefore, a method of forming concavities and convexities on the undercoat layer is used.

A mechanism of preventing the regular reflection of the coherent light and black spots on blank images by including the metal oxide besides the titanium oxide is not completely clarified yet. However, it is supposed that a small amount of the metal oxide present in a gap between the comparatively large titanium oxide particles, present thereon and present on a surface of the undercoat layer further forms fine concavities and convexities thereon in addition to large concavities and convexities of the titanium oxide, and therefore the coherent light is more scattered.

Particularly when the metal oxide besides the titanium oxide is an aluminum oxide, the coherent light is effectively scattered. In addition, the metal oxide having a small particle diameter present in a gap between the titanium oxide particles increases a coverage over the substrate and a charge injection therefrom is prevented, and therefore defective images such as black spots can be prevented.

The metal oxide besides the titanium oxide included in the undercoat layer is preferably from 0.1 to 10% by weight base on total weight of the titanium oxide. When greater than 10% by weight, the resultant photoreceptor has a larger environmental dependency, and has a larger black part potential with time in an environment of high temperature and humidity, and from the beginning in a low temperature and humidity environment, resulting in deterioration of image density. When less than 0.1% by weight, the light reflects more regularly and causes moire when writing with coherent light.

Further, a ratio (P/R) of a titanium oxide and another metal oxide (P) to a binder resin (R) included in the under coat layer is preferably from 0.9/1.0 to 2.0/1.0 by volume. The P/R is less than 0.9/1.0, properties of the undercoat layer are contingent to those of the binder resin, and particularly properties of the resultant photoreceptor largely changes due to a change of the temperature and humidity and repeated use. When the P/R is greater than 2.0/1.0, the undercoat layer includes more airspaces and deteriorates its adherence to a charge generation layer. Further, when the P/R is greater than 3.0/1.0, air is stored therein, which causes an air bubble when a photosensitive layer is coated and dried, resulting in defective coating.

The undercoat layer includes at least an oil-free alkyd resin including a hydroxyl group and block isocyanate resin.

The oil-free alkyd resin is a saturated polyester resin formed of a polybasic acid and a polyalcohol, and has a direct chain structure bonded with an ester bonding without a fatty acid. The oil-free alkyd resin has innumerable kinds according to the polybasic acid, polyalcohol and a modifying agent. Specific examples of the oil-free alkyd resin including a hydroxyl group include Bekkolite M-6401-50, M-6402-50, M-6003-60, M-6005-60, 46-118, 46-119, 52-584, M-6154-50, M-6301-45, 55-530, 54-707, 46-169-S, M-6201-40-1M, M-6205-50, 54-409 which are brand names of oil-free alkyd resins from Dainippon Ink And Chemicals, Inc.; and Espel 103, 110, 124 and 135 which are brand names of oil-free alkyd resins from Hitachi Chemical Co., Ltd.

The storage stability of a liquid formed of a solvent wherein an isocyanate resin and a pigment are dispersed is essential. Therefore, the isocyanate is preferably blocked with a blocker or inner blocked when stored in an environment of high temperature and high humidity or for long periods.

Specific examples of the block isocyanate resin include IPDI-B1065 and IPDI-B1530 which are brand names of isophoronediisocyanate using ϵ-caprolactam as a blocker from Degussa-Huls AG or IPDI-BF1540 which is a brand name of inner blocked urethodione bonding type block isophoronediisocyanate from HULS, and oxime-blocked 2,4-trilenediisocyanate, 2,6-trilenediisocyanate, diphenylmethane-4,4'-diisocyanate, hexamethylenediisocyanate, etc.

Specific examples of the oxime include formaldehyde oxime, acetoaldo oxime, methyl ethyl ketone oxime and cyclohexanone oxime. Specific examples of the oxime-blocked block isocyanate include DM-60 and DM-160 which are brand names from Meisei Chemical Works, Ltd. and Bumock B7-887-60, B3-867 and DB980K from Dainippon Ink And Chemicals, Inc.

The binder resin preferably has a hydroxyl value not less than 70. When less than 70, the crosslinking is not sufficiently performed because the binder resin has less reactive site with the isocyanate and the layer formability deteriorates, resulting in deterioration of adherence between a photosensitive layer and an electroconductive substrate. When greater than 150, a moisture resistance of the resultant photoreceptor deteriorates if an unreacted functional group remains, and tends to accumulate a charge in an environment of high humidity, resulting in extreme deterioration of photosensitivity thereof, image density due to increase of a dark part potential and halftone image reproducibility. The hydroxyl value is determined by a method specified in JIS K 0070.

The oil-free alkyd resin including a hydroxyl group included in the undercoat layer preferably has an equal number of moles of the hydroxyl group to that of the isocyanate group of the block isocyanate resin included therein. When the hydroxyl group or isocyanate group which is a reactive group performing a crosslinkage between the oil-free alkyd resin including a hydroxyl group and the block isocyanate resin is excessively present and remains as unreacted, the unreacted group in the undercoat layer accumulates a charge.

Specific examples of the solvent for use in a coating liquid for the undercoat layer include isopropanol, acetone, methyl ethyl ketone, cyclohexanone, tetrahydrofuran, dioxane, ethylcellosolve, ethyl acetate, methyl acetate, dichloromethane, monochlorobenzene, cyclohexane, toluene, xylene, ligroin, etc.

The titanium oxide included in the undercoat layer preferably has a particle diameter of from 0.05 to 1 μm, and more preferably from 0.1 to 0.5 μm. The other metal oxide preferably has a particle diameter of from 0.01 to 0.5 μm. In the present invention, the undercoat layer preferably has a thickness of from 0.1 to 50 μm, and more preferably of from 2 to 8 μm. When the undercoat layer has a thickness less than 2 μm, the coverage over the substrate is insufficient, a charge is injected into the photosensitive layer from the substrate, the resultant photoreceptor tends to produce images having black spots. When the undercoat layer has a thickness greater than 8 μm, a residual potential thereof increases.

Next, the electroconductive substrate and photosensitive layer will be explained.

Suitable materials as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing and the like treatments, can also be used as the substrate. In addition, the endless nickel belt and endless stainless belt disclosed in Japanese Laid-Open Patent Publication No. 52-36016 can also be used as the electroconductive substrate.

Further, an electroconductive powder dispersed in a proper binder resin can be coated on the above-mentioned substrate. Specific examples of the electroconductive powder include carbon powders such as carbon black and acetylene black; metallic powders such as aluminium, nickel, iron, nichrome, copper, zinc, and silver; or metallic oxides such as electroconductive titanium oxide, electroconductive tin oxide and ITO.

Specific examples of the binder resins include thermoplastic resins, thermosetting resins or photo-curing resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins. Such an electroconductive layer can be formed by coating a liquid wherein the electroconductive powder and binder resin are dispersed in a proper solvent such as tetrahydrofuran, dichloromethane, 2-butanone and toluene.

Further, a cylindrical substrate having an electroconductive layer formed of a heat contraction tube including a material such as polyvinylchloride, polypropylene, polyester, polystyrene, polyvinylidene, polyethylene, rubber chloride and Teflon (registered trade name) and the above-mentioned an electroconductive powder thereon can also be used as the electroconductive substrate.

The charge generation layer is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge generation materials can be used alone or in combination.

The charge generation layer includes a butyral resin as a binder resin in an amount of 50% by weight in Examples of the present invention. However, polyamide, polyurethane, epoxy resins, polyketone, polycarbonate, silicone resins, acrylic resins, polyvinyl formal, polyvinyl ketone, polystyrene, polyvinylcarbazole, polyacrylamide, polyvinylbenzal, polyester, phenoxy resins, vinylchloride-vinylacetate copolymers, polyvinylacetate, polyamide, polyvinylpyridine, cellulose resins, casein, polyvinylalcohol, polyvinylpyrrolidone, etc. can optionally be used together.

The charge generation layer preferably includes the binder resin in an amount of from 10 to 500 parts by weight, and more preferably from 25 to 300 parts per 100 parts by weight of the charge generation material.

Specific examples of the solvent for use in a coating liquid for the charge generation layer include isopropanol, acetone, methyl ethyl ketone, cyclohexanone, tetrahydrofuran, dioxane, ethylcellosolve, ethyl acetate, methyl acetate, dichloromethane, monochlorobenzene, cyclohexane, toluene, xylene, ligroin, etc. The charge generation layer is formed by coating a liquid wherein the charge generation material and binder resin are dispersed in a solvent on the undercoat layer, and drying the liquid.

The charge generation layer preferably has a thickness of from 0.01 to 5 μm, and more preferably of from 0.1 to 2 μm.

The charge transport materials included in the charge transport layer include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, other polymerized hole transport materials, and the like.

Specific examples of the binder resin for use in the charge transport layer include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the polycarbonate copolymers disclosed in Japanese Laid-Open Patent Publications Nos. 5-158250 and 6-51544.

The charge transport layer preferably includes the charge transport material of from 20 to 300 parts by weight, and more preferably from 40 to 150 parts by weight per 100 parts by weight of the binder resin. The charge transport layer preferably has a thickness of from 5 to 50 μm. Suitable solvents for use in the coating liquid for forming the charge transport layer include tetrahydrofuran, dioxane, toluene, dichloromethane, monochlorobenzene, dichloroethane, cyclohexanone, methyl ethyl ketone, acetone and the like solvents.

In the present invention, the charge transport layer may include a leveling agent and an antioxidant. Specific examples of the leveling agents include silicone oils such as dimethyl silicone oils and methylphenyl silicone oils; and polymers and oligomers having a perfluoroalkyl group in their side chain. A content of the leveling agent is from 0 to 1 part by weight per 100 parts by weight of the binder resin. Specific examples of the antioxidant include hindered phenolic compounds, sulfur compounds, phosphorous compounds, hindered amine compounds, pyridine derivatives, piperidine derivatives, morpholine derivatives, etc. The charge transport layer preferably includes the antioxidant of from 0 to 5 parts by weight per 100 parts by weight of the binder resin.

Coating methods for the electrophotographic photoreceptor include dip coating methods, spray coating methods, bead coating methods, nozzle coating methods, spinner coating methods, ring coating methods, Meyer bar coating methods, roller coating methods, curtain coating methods, etc.

Figure 3:
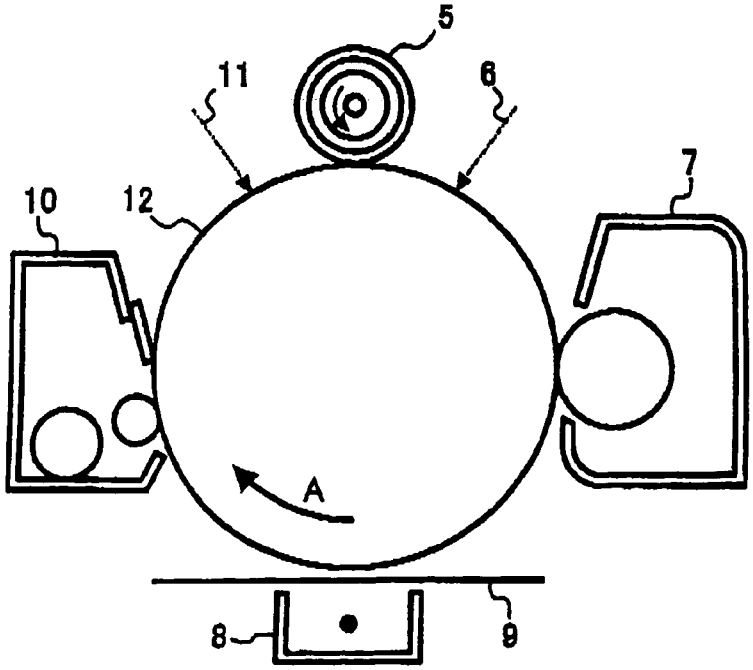
FIG. 3 is a schematic view illustrating a partial cross-section of an embodiment of the electrophotographic image forming apparatus of the present invention.

As shown in FIG. 3, in an electrophotographic image forming apparatus equipped with the electrophotographic photoreceptor of the present invention, a peripheral surface of the electrophotographic photoreceptor 12 rotating in the direction of an arrow A is positively or negatively charged by a charger 5 to have a predetermined voltage. A DC voltage is applied to the charger 5. The DC voltage applied thereto is preferably from −2,000 to +2,000 V.

In addition to the DC voltage, a pulsating flow voltage which is further overlapped with an AC voltage may be applied to the charger 5. The AC voltage overlapped with the DC voltage preferably has a voltage between peaks not greater than 4,000 V.

Besides indirect chargers such as scorotron and corotron chargers, a direct charger preventing an oxidizing gas is suggested.

The charger 5 can rotate in the same or reverse direction of the photoreceptor 12, or can slide on a peripheral surface thereof without rotating. Further, the charger may have a cleaning function to remove a residual toner on the photoreceptor 12. In this case, a cleaner 10 is not required.

The charged photoreceptor 12 receives imagewise light 6 (slit light or laser beam scanning light) from an irradiator (not shown). When the photoreceptor is irradiated, the irradiation is shut down for a non-image part of an original and a image part thereof having a low potential by the irradiation receives a developing bias slightly lower than the surface potential to perform a reversal development. Thus, an electrostatic latent image correlating to the original including the non-image part is sequentially formed.

The electrostatic latent image is developed by an image developer 7 with a toner to form a toner image. The toner image is sequentially transferred by a transferer 8 onto a recording material 9 fed from a paper feeder (not shown) between the photoreceptor 12 and transferer 8 in synchronization with the rotation of the photoreceptor 12. The recording material 9 having the toner image is separated from the photoreceptor and transferred to an image fixer (not shown) such that the toner image is fixed thereon to form a copy which is fed out from the image forming apparatus.

The surface of the photoreceptor 12 is cleaned by removing a residual toner after transferred, discharged by a pre-irradiation 11 and prepared for forming a following image.

A process cartridge combining plural constituents such as the photoreceptor and image developer in a body as a unit can detachably be used with an electrophotographic image forming apparatus.

Figure 4:
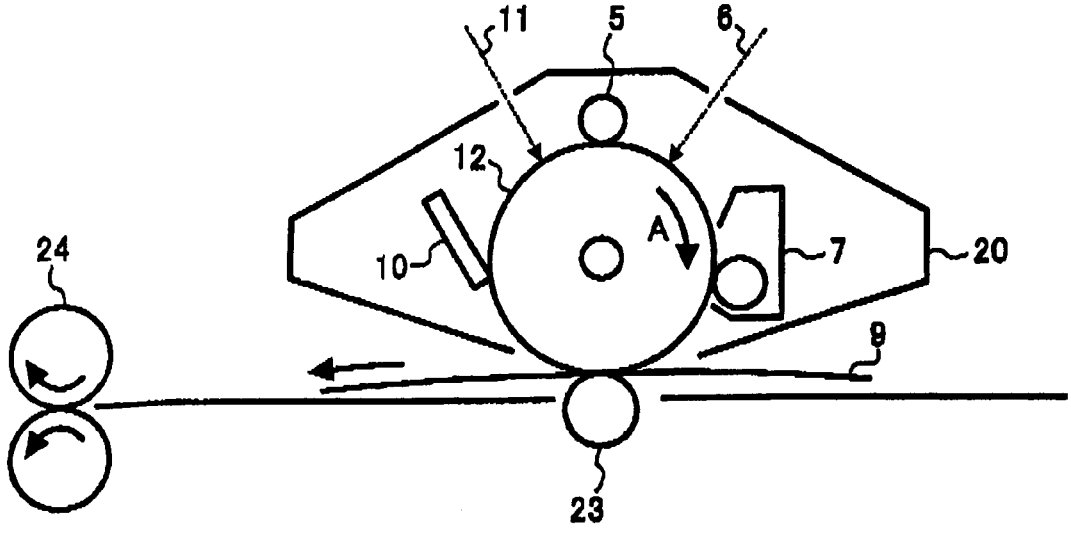
FIG. 4 is a schematic view illustrating a cross-section of an embodiment of the process cartridge of the present invention.

For instance, as shown in FIG. 4, at least a photoreceptor 12, a charger 5 and an image developer 7 are included in a container 20 as a unit for an electrophotographic image forming apparatus, and the apparatus unit may be detachable with the apparatus using guide means thereof such as a rail. A cleaner 10 need not be included in the container 20.

Figure 5:
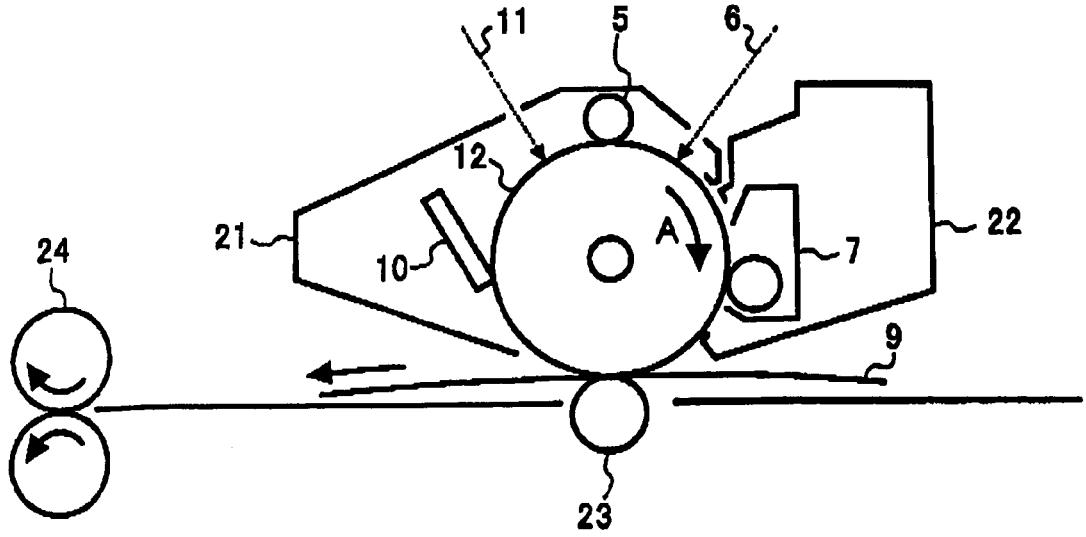
FIG. 5 is a schematic view illustrating a cross-section of another embodiment of the process cartridge of the present invention.

Further, as shown in FIG. 5, at least a photoreceptor 12 and a charger 5 are included in a first container 21 as a first unit and at least an image developer 7 is included in a second container 22 as a second unit, and the first and second unit may detachable with the apparatus.

As a transferer 23 in FIGS. 4 and 5, a transferer having the same configuration as that of the charger 5 can be used. A DC voltage of from 400 to 2,000 V is preferably applied to the transferer 23. Numeral 24 is a fixer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation for an Undercoat Layer Coating Liquid and a Coating Method Thereof

The following materials were mixed and dispersed in a ball mill for 96 hrs to prepare an undercoat layer coating liquid.

Titanium oxide 80

(CR97 having a purity of 93% by weight and an average particle diameter of 0.58 μm from Ishihara Sangyo Kaisha, Ltd.)

Silica 0.04

(SO-C1 having a purity not less than 99.8% by weight and an average particle diameter of 0.38 μm from ADMATECHS Co., Ltd.)

Oil-free alkyd resin 15

(Bekkolite M6805-40 having a solid content of 40% by weight and a hydroxyl value of 20 from Dainippon Ink & Chemicals, Inc.)

Block isocyanate resin 20

(Bumock B7-887-60 having a solid content of 60% by weight from Dainippon Ink and Chemicals, Inc.)

Methyl ethyl ketone 50

Cyclohexanone 50

The undercoat layer coating liquid was coated on an aluminum drum having a diameter of 30 mm and a length of 340 mm, and the liquid was dried at 140° for 25 min to form an undercoat layer having a thickness of 3.5 μm on the aluminum drum. As for the particle diameters of the titanium oxide and silica, a particle diameter distribution measurer (HRA from Microtrac Inc.) using a laser diffraction scattering method was used to measure center particle diameters and particle diameter distributions thereof.

Preparation for a Charge Generation Layer Coating Liquid and a Coating Method Thereof The following materials were mixed and dispersed in a ball mill for 216 hrs to prepare a dispersion.

τ-type metal-free phthalocyanine 12

(TPA-891 from Toyo Ink Mfg. Co. Ltd.)

Disazo pigment 24 having the following formula (1)

(1)

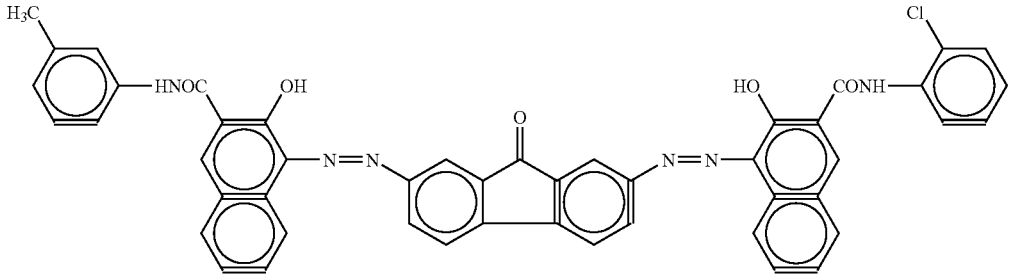

Cyclohexanone 330

Then, a resin solution wherein 6 parts by weight of polyvinylbutyral (XYHL from Union Carbide Corp.) are dissolved in 850 parts by weight of methyl ethyl ketone and 1,100 parts by weight of cyclohexanone was added to the dispersion, and the dispersion was further dispersed for 3 hrs to prepare a charge generation layer coating liquid. The charge generation layer coating liquid was coated on the aluminium drum with the undercoat layer prepared as above and the liquid was dried at 130° for 10 min to form a charge generation layer having a thickness of 0.2 μm on the undercoat layer.

Preparation for a Charge Transport Layer Coating Liquid and a Coating Method Thereof The following materials were mixed to prepare a charge transport layer coating liquid.

Charge transport material 8 having the following formula (2):

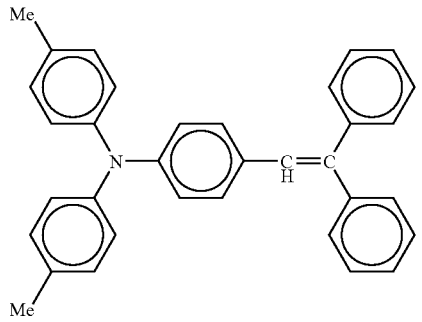

Polycarbonate 10

(Z-type having a viscosity-average molecular weight of 50,000)

Silicone oil 0.002

(KF-50 from Shin-Etsu Chemical Co., Ltd.)

Tetrahydrofuran 100

The charge transport layer coating liquid was coated on the charge generation layer, and the liquid was dried at 130° for 20 min to form a charge transport layer having a thickness of 30 μm. Thus, a photoreceptor of Example 1 was prepared.

Example 2

The procedure for preparation of the photoreceptor of Example 1 was repeated to prepare a photoreceptor of Example 2 except for changing an amount of the silica in the undercoat layer coating liquid from 0.04 to 0.08 parts by weight.

Example 3

The procedure for preparation of the photoreceptor of Example 1 was repeated to prepare a photoreceptor of Example 3 except for changing an amount of the silica in the undercoat layer coating liquid from 0.04 to 4 parts by weight.

Example 4

The procedure for preparation of the photoreceptor of Example 1 was repeated to prepare a photoreceptor of Example 4 except for changing an amount of the silica in the undercoat layer coating liquid from 0.04 to 8 parts by weight.

Example 5

The procedure for preparation of the photoreceptor of Example 1 was repeated to prepare a photoreceptor of Example 5 except for changing an amount of the silica in the undercoat layer coating liquid from 0.04 to 12 parts by weight.

Example 6

The procedure for preparation of the photoreceptor of Example 1 was repeated to prepare a photoreceptor of Example 6 except for changing the silica in the undercoat layer coating liquid to alumina (AO-502 having a purity not less than 99.8% by weight and an average particle diameter of 0.30 μm from ADMATECHS Co., Ltd.).

Example 7

The procedure for preparation of the photoreceptor of Example 6 was repeated to prepare a photoreceptor of Example 7 except for changing the an amount of the alumina in the undercoat layer coating liquid from 0.04 to 0.08 parts by weight.

Example 8

The procedure for preparation of the photoreceptor of Example 6 was repeated to prepare a photoreceptor of Example 8 except for changing the an amount of the alumina in the undercoat layer coating liquid from 0.04 to 4 parts by weight.

Example 9

The procedure for preparation of the photoreceptor of Example 6 was repeated to prepare a photoreceptor of Example 9 except for changing the an amount of the alumina in the undercoat layer coating liquid from 0.04 to 8 parts by weight.

Example 10

The procedure for preparation of the photoreceptor of Example 6 was repeated to prepare a photoreceptor of Example 10 except for changing the an amount of the alumina in the undercoat layer coating liquid from 0.04 to 12 parts by weight.

Example 11

The procedure for preparation of the photoreceptor of Example 7 was repeated to prepare a photoreceptor of Example 11 except for changing the titanium oxide from CR97 to CR-E1 having a purity of 99.7% by weight and an average particle diameter of 0.42 μm from Ishihara Sangyo Kaisha, Ltd. and oil-free alkyd resin from Bekkolite M6805-40 to Arakyd 9103 having a solid content of 60% by weight and a hydroxyl value of 57 from Arakawa Chemical Industries, Ltd. in the undercoat layer coating liquid.

Example 12

The procedure for preparation of the photoreceptor of Example 11 was repeated to prepare a photoreceptor of Example 12 except for changing an amount of the alumina in the undercoat layer coating liquid from 0.08 to 4 parts by weight.

Example 13

The procedure for preparation of the photoreceptor of Example 11 was repeated to prepare a photoreceptor of Example 13 except for changing an amount of the alumina in the undercoat layer coating liquid from 0.08 to 8 parts by weight.

Example 14

The procedure for preparation of the photoreceptor of Example 11 was repeated to prepare a photoreceptor of Example 14 except for changing the oil-free alkyd resin from Arakyd 9103 to Bekkolite M6163-60 having a solid content of 60% by weight and a hydroxyl value of 70 from Dainippon Ink & Chemicals, Inc.

Example 15

The procedure for preparation of the photoreceptor of Example 14 was repeated to prepare a photoreceptor of Example 15 except for changing an amount of the alumina in the undercoat layer coating liquid from 0.08 to 4 parts by weight.

Example 16

The procedure for preparation of the photoreceptor of Example 14 was repeated to prepare a photoreceptor of Example 16 except for changing an amount of the alumina in the undercoat layer coating liquid from 0.08 to 8 parts by weight.

Example 17

The procedure for preparation of the photoreceptor of Example 14 was repeated to prepare a photoreceptor of Example 17 except for changing the oil-free alkyd resin from Bekkolite M6163-60 to Bekkolite M6401-50 having a solid content of 50% by weight and a hydroxyl value of 130 from Dainippon Ink & Chemicals, Inc.

Example 18

The procedure for preparation of the photoreceptor of Example 17 was repeated to prepare a photoreceptor of Example 18 except for changing an amount of the alumina in the undercoat layer coating liquid from 0.08 to 4 parts by weight.

Example 19

The procedure for preparation of the photoreceptor of Example 17 was repeated to prepare a photoreceptor of Example 19 except for changing an amount of the alumina in the undercoat layer coating liquid from 0.08 to 8 parts by weight.

Comparative Example 1

The procedure for preparation of the photoreceptor of Example 1 was repeated to prepare a photoreceptor of Comparative Example 1 except for excluding the silica in the undercoat layer coating liquid.

Comparative Example 2

The procedure for preparation of the photoreceptor of Example 11 was repeated to prepare a photoreceptor of Comparative Example 2 except for excluding the alumina in the undercoat layer coating liquid.

Comparative Example 3

The procedure for preparation of the photoreceptor of Example 14 was repeated to prepare a photoreceptor of Comparative Example 3 except for excluding the alumina in the undercoat layer coating liquid.

Comparative Example 4

The procedure for preparation of the photoreceptor of Example 17 was repeated to prepare a photoreceptor of Comparative Example 4 except for excluding the alumina in the undercoat layer coating liquid.

The thus prepared photoreceptors of Examples 1 to 19 and Comparative Examples 1 to 4 were installed in Imagio MF2730 from Ricoh Company, Ltd., and the following items were evaluated.

Interference Pattern

A halftone image was produced to visually observe occurrence of interference patterns. Evaluation ranks are as follows:

○: None
Δ: slightly observed
x: clearly observed

Black Spots 50,000 images of a chart having a black solid image of 5% were continuously produced. A black part potential ($V_L$) before and after the image production was measured, and black spots when a blank image was produced were evaluated as follows:

○: None
Δ: slightly observed
x: clearly observed

Image Density Deterioration of Black Solid Image

In an environment of high temperature and high humidity and that of low temperature and low humidity, 1,000 images were continuously produced to measure $V_L$ and evaluate image density deterioration of black solid image after the image production. Evaluation ranks are as follows:

○: Not deteriorated
Δ: slightly deteriorated
x: clearly deteriorated

Image evaluation results and dark space potentials before and after 50,000 images were produced are shown in Tables 1-1 and 1-2. When a metal oxide besides the titanium oxide is included in the undercoat layer, an interference pattern in a halftone image and a black spot on a blank image are prevented. In addition, when the metal oxide is included in an amount of from 0.1 to 10% by weight based on total weight of the titanium oxide, the metal oxide is alumina and the titanium oxide has a high purity, the interference pattern and black spot can be more effectively prevented. Further, when the titanium oxide has a high purity and the metal oxide besides the titanium oxide is included in the undercoat layer in an amount of not greater than 10% by weight, the dark space potential does not increase much and the resultant photoreceptor has good durability.

The dark space potential in the apparatus and evaluation results of the black part image density before and after 1,000 images were produced in an environment of high temperature and high humidity (30° C. and 90%) and that of low temperature and low humidity (10° C. and 15%) are shown in Table 2. In an environment of high temperature and high humidity, when the metal oxide besides the titanium oxide is included in the undercoat layer in an amount of not less than 10% and the titanium oxide has a low purity, the dark space potential largely increases. In an environment of low temperature and low humidity, when the titanium oxide has a low purity and the hydroxyl value is low, the dark space potential is high from the beginning. Further, when the dark space potential is high, the black part image density deteriorates.

TABLE 1-1

| | Metal oxide besides titanium oxide | | | Titanium oxide | | | Alkyd resin | |
|---|---|---|---|---|---|---|---|---|
| | Name | Average particle diameter (μm) | Content per 100% of titanium oxide | Name | Purity (%) | Average particle diameter (μm) | Name | Hydroxyl value |
| Ex. 1 | Silica | 0.38 | 0.05 | CR97 | 93 | 0.58 | M680 5-40 | 20 |
| Ex. 2 | Silica | 0.38 | 0.1 | CR97 | 93 | 0.58 | M680 5-40 | 20 |
| Ex. 3 | Silica | 0.38 | 5 | CR97 | 93 | 0.58 | M680 5-40 | 20 |
| Ex. 4 | Silica | 0.38 | 10 | CR97 | 93 | 0.58 | M680 5-40 | 20 |
| Ex. 5 | Silica | 0.38 | 15 | CR97 | 93 | 0.58 | M680 5-40 | 20 |
| Ex. 6 | Alumina | 0.30 | 0.05 | CR97 | 93 | 0.58 | M680 5-40 | 20 |
| Ex. 7 | Alumina | 0.30 | 0.1 | CR97 | 93 | 0.58 | M680 5-40 | 20 |
| Ex. 8 | Alumina | 0.30 | 5 | CR97 | 93 | 0.58 | M680 5-40 | 20 |
| Ex. 9 | Alumina | 0.30 | 10 | CR97 | 93 | 0.58 | M680 5-40 | 20 |
| Ex. 10 | Alumina | 0.30 | 15 | CR97 | 93 | 0.58 | M680 5-40 | 20 |
| Ex. 11 | Alumina | 0.30 | 0.1 | CR-EL | 99.7 | 0.42 | Arakyd 9103 | 55 |
| Ex. 12 | Alumina | 0.30 | 5 | CR-EL | 99.7 | 0.42 | Arakyd 9103 | 55 |
| Ex. 13 | Alumina | 0.30 | 10 | CR-EL | 99.7 | 0.42 | Arakyd 9103 | 55 |
| Ex. 14 | Alumina | 0.30 | 0.1 | CR-EL | 99.7 | 0.42 | M616 3-60 | 70 |
| Ex. 15 | Alumina | 0.30 | 5 | CR-EL | 99.7 | 0.42 | M616 3-60 | 70 |
| Ex. 16 | Alumina | 0.30 | 10 | CR-EL | 99.7 | 0.42 | M616 3-60 | 70 |
| Ex. 17 | Alumina | 0.30 | 0.1 | CR-EL | 99.7 | 0.42 | M640 1-50 | 130 |
| Ex. 18 | Alumina | 0.30 | 5 | CR-EL | 99.7 | 0.42 | M640 1-50 | 130 |
| Ex. 19 | Alumina | 0.30 | 10 | CR-EL | 99.7 | 0.42 | M640 1-50 | 130 |
| Com. Ex. 1 | None | — | 0 | CR97 | 93 | — | M680 5-40 | 20 |
| Com. Ex. 2 | None | — | 0 | CR-EL | 99.7 | — | Arakyd 9103 | 55 |
| Com. Ex. 3 | None | — | 0 | CR-EL | 99.7 | — | M616 3-60 | 70 |
| Com. Ex. 4 | None | — | 0 | CR-EL | 99.7 | — | M640 1-50 | 130 |

TABLE 1-2

| | Interference pattern | Black spots | | | | | | Dark Space potential (V) | |
|---|---|---|---|---|---|---|---|---|---|
| | | Initial | 10K | 20K | 30K | 40K | 50K | Initial | After image production |
| Ex. 1 | x | ○ | ○ | ○ | Δ | Δ | x | 135 | 140 |
| Ex. 2 | Δ | ○ | ○ | ○ | ○ | ○ | ○ | 135 | 140 |
| Ex. 3 | ○ | ○ | ○ | ○ | ○ | ○ | ○ | 135 | 140 |

TABLE 1-2-continued

| | Interference pattern | Black spots Initial | 10K | 20K | 30K | 40K | 50K | Dark Space potential (V) Initial | After image production |
|---|---|---|---|---|---|---|---|---|---|
| Ex. 4 | ○ | ○ | ○ | ○ | ○ | ○ | ○ | 135 | 140 |
| Ex. 5 | Δ | ○ | ○ | ○ | ○ | Δ | Δ | 140 | 150 |
| Ex. 6 | Δ | ○ | ○ | ○ | ○ | ○ | ○ | 135 | 135 |
| Ex. 7 | ○ | ○ | ○ | ○ | ○ | ○ | ○ | 135 | 135 |
| Ex. 8 | ○ | ○ | ○ | ○ | ○ | ○ | ○ | 135 | 135 |
| Ex. 9 | ○ | ○ | ○ | ○ | ○ | ○ | ○ | 135 | 140 |
| Ex. 10 | ○ | ○ | ○ | ○ | ○ | ○ | ○ | 140 | 145 |
| Ex. 11 | ○ | ○ | ○ | ○ | ○ | ○ | ○ | 135 | 140 |
| Ex. 12 | ○ | ○ | ○ | ○ | ○ | ○ | ○ | 135 | 140 |
| Ex. 13 | ○ | ○ | ○ | ○ | ○ | ○ | ○ | 135 | 140 |
| Ex. 14 | ○ | ○ | ○ | ○ | ○ | ○ | ○ | 135 | 140 |
| Ex. 15 | ○ | ○ | ○ | ○ | ○ | ○ | ○ | 135 | 140 |
| Ex. 16 | ○ | ○ | ○ | ○ | ○ | ○ | ○ | 135 | 140 |
| Ex. 17 | ○ | ○ | ○ | ○ | ○ | ○ | ○ | 135 | 140 |
| Ex. 18 | ○ | ○ | ○ | ○ | ○ | ○ | ○ | 135 | 140 |
| Ex. 19 | ○ | ○ | ○ | ○ | ○ | ○ | ○ | 140 | 145 |
| Com. Ex. 1 | x | x | x | x | x | x | x | 150 | 195 |
| Com. Ex. 2 | x | Δ | Δ | x | x | x | x | 150 | 175 |
| Com. Ex. 3 | x | Δ | Δ | x | x | x | x | 155 | 180 |
| Com. Ex. 4 | x | Δ | Δ | Δ | x | x | x | 160 | 175 |

TABLE 2

| | 30° C. 90% Inner voltage (V) | Deterioration of black solid image density | 10° C. 15% Inner voltage (V) | Deterioration of black solid image density |
|---|---|---|---|---|
| Ex. 1 | 140 | ○ | 135 | ○ |
| Ex. 2 | 140 | ○ | 135 | ○ |
| Ex. 3 | 140 | ○ | 135 | ○ |
| Ex. 4 | 145 | ○ | 145 | ○ |
| Ex. 5 | 150 | ○ | 135 | ○ |
| Ex. 6 | 140 | ○ | 135 | ○ |
| Ex. 7 | 140 | ○ | 135 | ○ |
| Ex. 8 | 140 | ○ | 135 | ○ |
| Ex. 9 | 140 | ○ | 140 | ○ |
| Ex. 10 | 145 | ○ | 140 | ○ |
| Ex. 11 | 140 | ○ | 135 | ○ |
| Ex. 12 | 140 | ○ | 135 | ○ |
| Ex. 13 | 140 | ○ | 135 | ○ |
| Ex. 14 | 140 | ○ | 135 | ○ |
| Ex. 15 | 140 | ○ | 135 | ○ |
| Ex. 16 | 140 | ○ | 135 | ○ |
| Ex. 17 | 145 | ○ | 135 | ○ |
| Ex. 18 | 145 | ○ | 135 | ○ |
| Ex. 19 | 145 | ○ | 135 | ○ |
| Com. Ex. 1 | 195 | x | 155 | Δ |
| Com. Ex. 2 | 180 | Δ | 155 | Δ |
| Com. Ex. 3 | 185 | x | 150 | Δ |
| Com. Ex. 4 | 200 | x | 150 | Δ |

In addition to the above described devices, the present application is directed to an electrophotographic image forming method. The method includes charging an electrophotographic photoreceptor as described in the preceding paragraphs. The method also includes a) irradiating the electrophotographic photoreceptor to form an electrostatic latent image thereon; b) developing the electrostatic latent image with a toner to form a toner image thereon; c) transferring the toner image onto a receiving material; d) fixing the toner image on the receiving material; e) removing the toner remaining on the electrophotographic photoreceptor after said step of transferring; and f) discharging the electrophotographic photoreceptor.

This document claims priority and contains subject matter related to Japanese Patent Application No. 2003-324905 filed on Sep. 17, 2003, the contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate;

an undercoat layer located overlying the electroconductive substrate; and a photosensitive layer located overlying the undercoat layer, wherein the undercoat layer comprises:

a titanium oxide;

an oil-free alkyd resin;

a block isocyanate compound; and a metal oxide different from the titanium oxide, said metal oxide having an average particle diameter smaller than an average particle diameter of said titanium oxide.

2. The electrophotographic photoreceptor of claim 1, wherein the titanium oxide has an average particle diameter (A) of from 0.05 to 1 μm, the metal oxide has an average particle diameter (B) of from 0.01 to 0.5 μm, and A is larger than B.

3. The electrophotographic photoreceptor of claim 1, wherein the undercoat layer comprises the metal oxide in an amount of from 0.1 to 10% by weight based on total weight of the titanium oxide.

4. The electrophotographic photoreceptor of claim 1, wherein the metal oxide is an aluminium oxide.

5. The electrophotographic photoreceptor of claim 1, wherein the titanium oxide has a purity not less than 99.2% by weight.

6. The electrophotographic photoreceptor of claim 1, wherein the oil-free alkyd resin has a hydroxyl group and a hydroxyl value not less than 70.

7. The electrophotographic photoreceptor of claim 1, wherein an ratio (P/R) of the titanium oxide and the metal oxide (P) to the oil-free alkyd resin (R) is 0.9/1.0 by volume.

8. An electrophotographic image forming method, comprising:

charging an electrophotographic photoreceptor as described in claim 1;

irradiating the electrophotographic photoreceptor to form an electrostatic latent image thereon;

developing the electrostatic latent image with a toner to form a toner image thereon;

transferring the toner image onto a receiving material;

fixing the toner image on the receiving material;

removing the toner remaining on the electrophotographic photoreceptor after said step of transferring; and discharging the electrophotographic photoreceptor.

9. An electrophotographic image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image thereon;

a transferer configured to transfer the toner image onto a receiving material;

a fixer configured to fix the toner image on the receiving material;

a cleaner configured to remove the toner remaining on the electrophotographic photoreceptor after transferred; and a discharger configured to discharge the electrophotographic photoreceptor.

10. A process cartridge, comprising:

the electrophotographic photoreceptor according to claim 1; and at least one of a charger and an image developer.

* * * * *